United States Patent [19]

Nakatani et al.

[11] Patent Number: 4,957,079

[45] Date of Patent: Sep. 18, 1990

[54] CAMSHAFT STRUCTURE FOR DOUBLE OVERHEAD CAMSHAFT ENGINE

[75] Inventors: Shigeki Nakatani; Naohide Koshimoto; Hiroyuki Sugimoto, all of Hiroshima, Japan

[73] Assignee: Mazda Motor Corporation, Hiroshima, Japan

[21] Appl. No.: 442,794

[22] Filed: Nov. 29, 1989

[30] Foreign Application Priority Data

Dec. 3, 1988 [JP] Japan ..... 63-306285

[51] Int. Cl.[5] ..... F01M 9/10

[52] U.S. Cl. ..... 123/90.34; 123/90.27; 123/196 M; 184/6.5

[58] Field of Search ..... 123/90.27, 90.33, 90.34, 123/196 M; 184/6.5

[56] References Cited

U.S. PATENT DOCUMENTS

| | | | |
|---|---|---|---|
| 4,441,465 | 4/1984 | Nakamura | 123/196 M |
| 4,537,166 | 8/1985 | Kimura et al. | 123/90.34 |
| 4,553,510 | 11/1985 | Yano et al. | 123/90.34 |
| 4,632,073 | 12/1986 | Futakuchi | 123/90.27 |
| 4,658,769 | 4/1987 | Horio et al. | 123/90.27 |
| 4,754,729 | 7/1988 | Abe et al. | 123/90.34 |
| 4,777,842 | 10/1988 | Yamada | 123/90.34 |
| 4,840,149 | 6/1989 | Fujita | 123/90.34 |

FOREIGN PATENT DOCUMENTS

| | | | |
|---|---|---|---|
| 25711 | 3/1978 | Japan | 123/90.34 |

*Primary Examiner*—Charles J. Myhre
*Assistant Examiner*—Weilun Lo
*Attorney, Agent, or Firm*—Fleit, Jacobson, Cohn, Price, Holman & Stern

[57] ABSTRACT

An overhead camshaft structure for a double overhead camshaft engine having at least three in-line cylinders and two camshafts which are formed with series of pairs of cam lobes and series of camshaft journals, respectively, and are operatively connected with each other by helical gears comprises a thrust collar formed on each camshaft, a thrust bearing formed with a thrust restrictive groove consisting of an upper half and a lower half, narrower than the upper half, for receiving therein the thrust collar, and an oil passage consisting of a radial passage portion penetrating through the thrust collar and an axial passage portion formed in each camshaft for allowing oil to pass up to each cam lobe and camshaft journal for lubrication. The radial passage is directed in parallel with a straight line connecting an axial centerline of rotation of each said camshaft and a juncture of a valve opening ramp of said cam lobe adjacent to said thrust collar.

8 Claims, 4 Drawing Sheets

CAMSHAFT STRUCTURE FOR DOUBLE OVERHEAD CAMSHAFT ENGINE

FIELD OF THE INVENTION

The present invention relates to a thrust restrictive structure for an overhead camshaft of a double overhead camshaft internal combustion engine, and more particularly to a thrust restrictive structure consisting of a thrust collar and a thrust bearing for an overhead camshaft of a double overhead camshaft internal combustion engine having two overhead camshafts rotatively connected to each other by a pair of helical gears.

BACKGROUND OF THE INVENTION

A double overhead camshaft internal combustion engine has intake and exhaust camshafts mounted on a cylinder head. The intake and exhaust camshafts are operatively connected to each other with helical gears and are timely turned by means of a timing chain stretched between a sprocket wheel secured to either one of the intake and exhaust camshafts and a sprocket wheel secured to an output shaft, such as a crankshaft, of the double overhead camshaft internal combustion engine.

To prevent the intake and exhaust camshafts from causing thrust movement due to the operative connection of the intake and exhaust camshafts with the helical gears, each of the intake and exhaust camshafts is generally provided with a thrust restrictive collar which is received in an annular groove which is formed in a thrust bearing block which is divided into two halves: an upper half being formed integrally with the cylinder head of the engine body and a lower half being formed integrally with a bearing cap and hereinafter referred to as a plain split thrust bearing block.

In the meantime, as a lubrication system for the thrust restrictive structure for the intake and exhaust cam shafts of the double overhead camshaft engine, it is popular to lubricate the thrust restrictive collars in the annular grooves formed in the plain split thrust bearing blocks by lubrication oil supplied from outside the thrust restrictive structures. In such a lubrication system, however, an external oil passage or passages has or have to be provided to carry the lubrication oil to the thrust collars. In an attempt at eliminating such an arrangement of oil passages, the overhead camshaft is formed with an oil passage extending along its length in parallel with an axial centerline of rotation thereof; the axial oil passage is communicated with an internal oil passage, radially extending from the axial oil passage formed and opening to the annular groove of the plain split thrust bearing block, formed in the thrust collar to carry the lubrication oil to the thrust collar. Forming the radial oil passage causes a decrease in structural rigidity or stiffness of the thrust collar.

To understand physical phenomena occurring in the overhead camshafts formed with the thrust collars having radial oil passages penetrating therethrough for, in particular, three cylinder internal combustion engines, such as in-line three cylinder internal combustion engines or V-6 type internal combustion engines, reference is had to FIGS. 1(A) to 1(C). Because of such an overhead camshaft having three, or three pairs of, cams for three cylinders which are adapted not to overlap in lift cycles relative to one another, driving torque for the intake and exhaust camshafts varies considerably with changes of crank angle or valve lift as shown by graphs in FIGS. 1(A) and 1(B), respectively. Because a peak of change in driving torque in an exhaust cycle for each cylinder is substantially the same in time-phase as a peak of change in driving torque in an intake cycle for a cylinder fired ahead of the cylinder, the interconnected intake and exhaust camshafts interact with each other to cause an increase in torque change developed by each overhead camshaft as shown by a graph in FIG. 1(C). Such a torque change is altered or changed to a thrust loaded on the overhead camshaft through the helical gears. Accordingly, the provision of radial oil passages opening to the annular groove of the plain split thrust bearing block leads to a serious problem of a decrease of rigidity of the thrust collar.

The plain split thrust bearing block for supporting the overhead camshaft, which generally consists of upper and lower halves bolted to each other, is formed with an inner groove divided into upper and lower halves for receiving therein the thrust collar. Because of the difficulty of accurately aligning upper and lower inner grooves of the upper and lower halves of the plain split thrust bearing block, either one of the upper and lower inner grooves is formed wider than the other inner groove so as to substantially support the thrust collar by the one of the upper and lower halves of the plain split thrust bearing block only. In the case of using such a plain split thrust bearing block together with the thrust collar with oil passages opening to the inner groove of the plain split thrust bearing block, the thrust collar is considerably lowered in rigidity or strength against thrust when the radial oil passage is located by the thrust collar in parallel with a fitting surface of the upper and lower halves of the plain split thrust bearing block, particularly, at a moment a maximum thrust is loaded on the overhead camshaft.

SUMMARY OF THE INVENTION

The primary object of the present invention is to provide a thrust restrictive structure of an overhead camshaft for a double overhead camshaft internal combustion engine in which is a thrust restrictive means is well lubricated and improved in structural rigidity.

The object of the present invention is achieved by a thrust restrictive structure of an overhead camshaft for a double overhead camshaft internal combustion engine comprising a cylinder block formed with a series of at least three in-line cylinders, a cylinder head and two camshafts, each of which is mounted on the cylinder head and formed with a series of pairs of cam lobes, and a series of camshaft bearing journals, one between each pair of cam lobes. The camshafts are operatively connected with each other by means of helical gears connected to the two camshafts, respectively, and provided with annular thrust collars formed adjacent to the respective helical gears thereon. A plain split thrust bearing, which consists of upper and lower halves for supporting each camshaft therebetween, is formed with a thrust restrictive groove consisting of an upper half formed in the upper half of the thrust bearing and a lower half formed in the lower half of the thrust bearing, the upper half of the thrust restrictive groove being wider than the lower half of the thrust restrictive groove, for receiving therein the thrust collar. Lubrication oil is introduced into an oil passage consisting of a penetrated oil passage portion formed in the thrust collar and an axial oil passage portion formed in each camshaft along its length and passes up to each camshaft bearing journal. The penetrated oil passage is so directed as to be in parallel with a straight line connecting an axial centerline of rotation of each camshaft and a juncture of a valve opening ramp of the cam lobe adjacent to the thrust collar.

The two camshafts, intake and exhaust, either one of which is driven from a crankshaft of the internal combustion engine, are timed to rotate by the helical gears in mesh with each other to open and close cylinder calves. The camshafts, when they rotate to open and close the cylinder valves, produce thrust according to a torque composed by means of the helical gears, so as to cause an axial movement of the camshafts. To restrict the axial movement of each camshaft, the camshaft is provided with the thrust collar supported for rotation by a thrust bearing block. Because the upper half of the thrust restrictive groove is wider than the lower half thereof, the thrust on the overhead camshaft is substantially fully supported by the lower half of the thrust bearing bearing.

Lubricating oil is drawn, by means of an oil pump of a pressure system, from a pan sump. The pump then forces the oil, through special oil passages, into the thrust restrictive groove to oil the thrust collar and bearing. The overhead camshaft and its thrust collar are drilled through substantially their full length to permit the oil in the annular groove of the thrust bearing block to pass to the camshaft bearing journals.

In the in-line three cylinder internal combustion engine, the overhead camshaft generally produces a thrust directly governed by the change of camshaft driving torque caused by each cam lobe. However, in accordance with the present invention, the radial oil passage formed in the thrust collar of the thrust restrictive structure according to the present invention lies in parallel with a straight line connecting the axial centerline of rotation of the overhead camshaft and a juncture of a valve opening ramp and a base of a specific cam lobe. Therefore, the orientation of the radial oil passage of the thrust collar is inconsistent with a fitting plane of the plain split thrust bearing block when the thrust collar is forced against the plain split thrust bearing with a maximum thrust produced by the reference cam lobe at the beginning of opening of the cylinder valve. Furthermore, the camshaft having the thrust collar thus formed places the thrust collar in a position where the penetrated oil passage is also inconsistent in orientation with the fitting plane of the plain split thrust bearing even when the thrust collar is forced against the plain split thrust bearing with a maximum thrust produced by any remaining cam lobe, other than the reference cam lobe. Accordingly, the thrust collar, whose penetrated oil passage is always inconsistent in orientation with the fitting plane of the plain split thrust bearing every time the camshaft is subjected to a maximum torque, is suppressed to lower in rigidity even the provision of the penetrated oil passage.

BRIEF DESCRIPTION OF THE DRAWINGS

Still other objects of the invention and more specific features will become apparent to those skilled in the art from the following description of the preferred embodiment considered together with the accompanying drawings wherein like reference characters have been used in the different figures to denote the same parts and in which.

DESCRIPTION OF THE PREFERRED EMBODIMENT

Figure 1A:
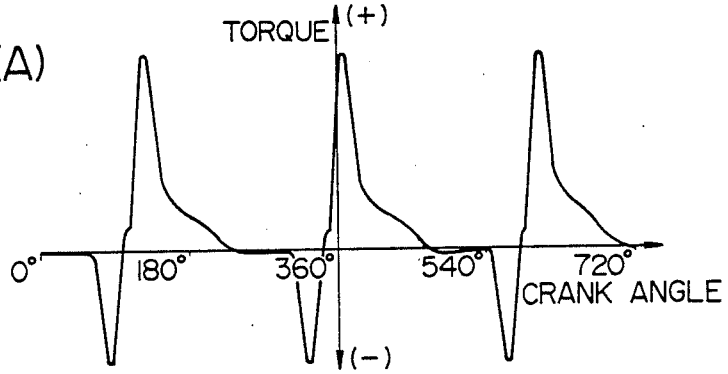
FIGS. 1(A) to 1(C) show graphs of torque changes caused by an overhead camshaft.
Figure 1B:
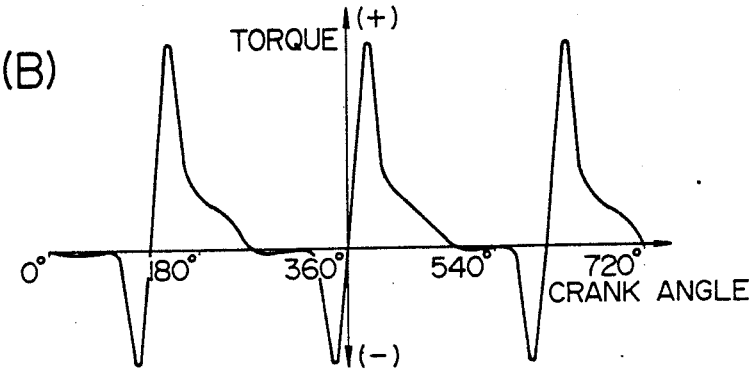
Figure 1C:
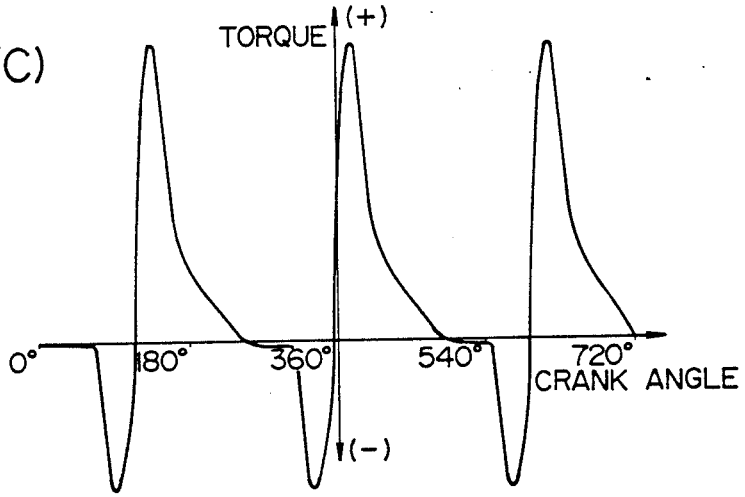
Figure 2:
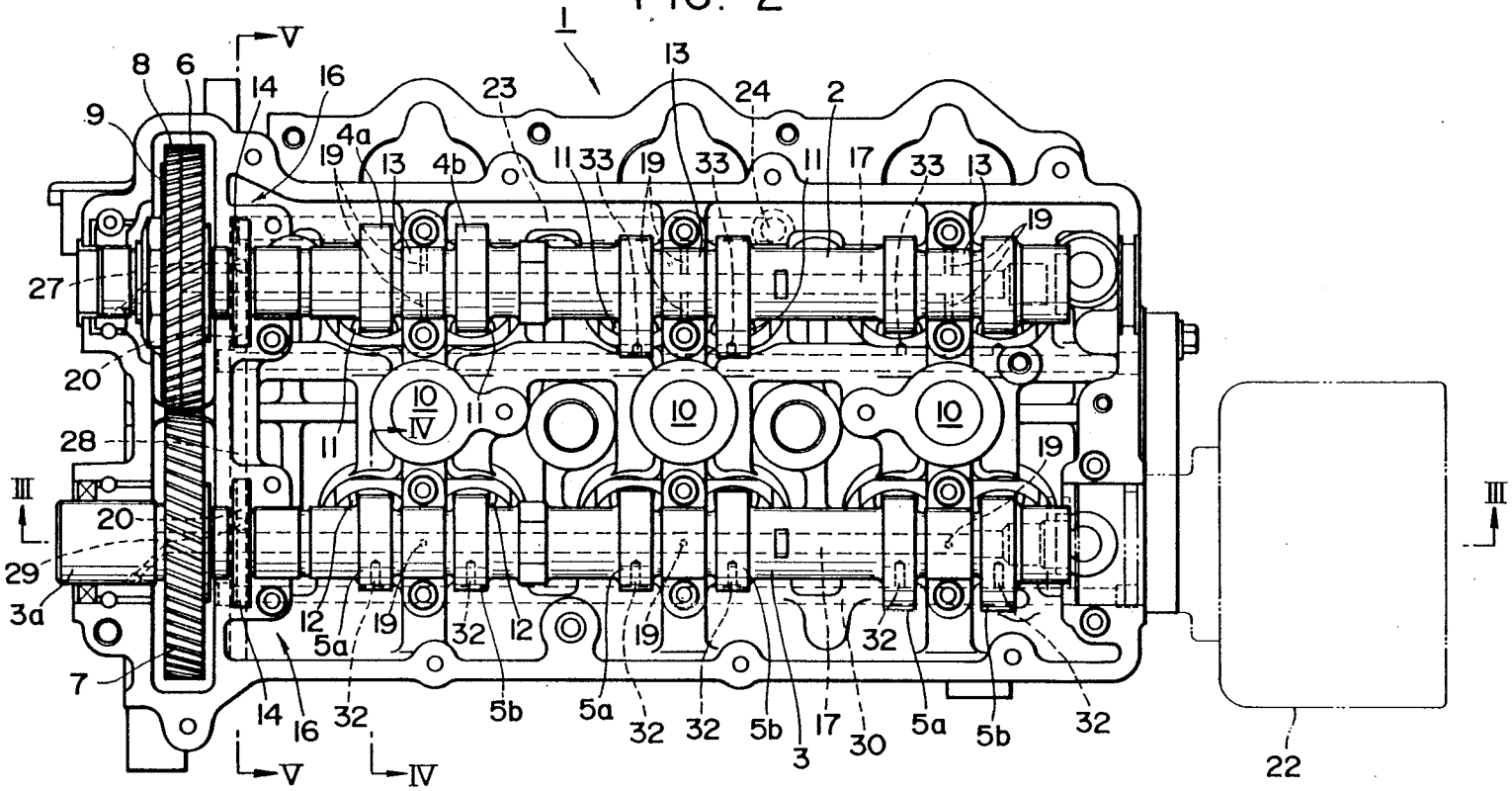
FIG. 2 is a schematic plan view showing partly a V-6 double overhead camshaft internal combustion engine with a thrust restrictive structure for a camshaft in accordance with a preferred embodiment of the present invention.

As understood by those skilled in the art, an engine body of a V-6 double overhead camshaft internal combustion engine consists of left and right or first and second cylinder banks arranged in a V-formation with a predetermined relative angle and two overhead camshafts for each of the left and right rows of cylinders formed in the first and second cylinder banks, respectively. Each of the overhead camshafts is provided with a thrust movement restrictive structure in accordance with a preferred embodiment of the present invention. The first and second cylinder banks are substantially the same in structure and operation, so that the following detailed description will be had in association with one cylinder bank only.

Parts which are not of direct importance to the invention and parts which are purely of conventional construction will not be shown or described in detail. For example, details of the timing chain drive means, the timing chain itself, the crankshaft and so forth which are necessary to turn camshafts or the pressure oiling system which is necessary to lubricate various elements will not be set out since their construction and operation can easily be arrived at by those skilled in the art.

Referring to the drawings in detail, particularly to FIGS. 2 to 5, a cylinder head 1 of one of right or first and left or second cylinder banks of a V-6 double overhead camshaft internal combustion engine having overhead camshafts each of which cooperates with a thrust restrictive structure in accordance with a preferred embodiment of the present invention is shown. The cylinder head 1, which is provided with two intake valves (not shown) and two exhaust valves 34 (see Figure 5) for each of a row of three cylinders, rotatively mounts thereon two overhead camshafts: an intake overhead camshaft 2 and an exhaust camshaft 3 juxtaposed in parallel with each other. The intake overhead camshaft 2 is either integrally formed or fixedly attached with intake cams 4*a* and 4*b* along its length; two for each cylinder and therefore, six in total for the three cylinders. Similarly, the exhaust overhead camshaft 3 is either integrally formed or fixedly attached with exhaust cams 5*a* and 5*b* along its length; two for each cylinder and therefore, six in total for the three cylinders. The intake and exhaust overhead camshafts 2 and 3 are provided with helical gears 6 and 7 which are, respectively, secured to one end of the overhead camshafts 2 and 3 or at one or a front side of the cylinder head 1 and are in mesh with each other. The exhaust overhead camshaft 3 has an overhead camshaft extension 3*a* extending forwardly from the helical gear 7 for operatively coupling itself to a timing drive means which is not shown but may be of a well known type. The timing drive means generally consists of a driven sprocket wheel secured to the overhead camshaft extension 3*a*, a driving sprocket wheel secured to one end of a crankshaft of the V-6 internal combustion engine and a timing chain stretched between the driving and driven sprocket wheels. By means of the timing drive means, the exhaust overhead camshaft 3, and hence the intake overhead camshaft 2, are timed to turn at one-half crankshaft speed. A friction helical gear 8, which is mounted for rotation on the intake overhead camshaft 2 on the front side of the helical gear 6 and is forced against the helical gear 6 of the intake overhead camshaft 2 by means of a spring ring 9, is in mesh with the helical gear 7 of the exhaust camshaft 3. The friction helical gear 8 is thinner than the helical gear 6 of the intake overhead camshaft 2 and provided with a number of teeth one more than that of the helical gear 6 of the intake overhead camshaft 2, thereby undergoing a rotational displacement relative to the helical gear 6 of the intake overhead camshaft 2 in a direction in which it turns when the helical gear 6 secured to the intake overhead camshaft 2 and friction helical gear 8 mounted for rotation on the intake overhead camshaft 2 are turned by the helical gear 7 of the exhaust overhead camshaft 3 so as to eliminate or reduce considerably a backlash or play between the helical gears 6 and 7 and remarkably decrease noises produced by teeth in mesh with each other.

The cylinder head 1 is formed with plug holes 10, one for each cylinder, in the upper wall along its axial centerline and intake and exhaust valve holes 11 and 12, respectively, two for each cylinder. The intake and exhaust overhead camshafts 2 and 3 have series of camshaft bearing journals 18 along their length and are held for rotation by bearing caps 13 bolted to the upper wall of the cylinder head 1. As shown in detail in FIG. 5, slidably received in the exhaust valve hole 12 is a valve lift 34*b* secured to a top end of a valve stem 34*a* of the exhaust valve 34. Similarly, the intake valve hole 11 slidably receives valve lift secured to a top end of a valve stem of the intake valve.

Figure 3:
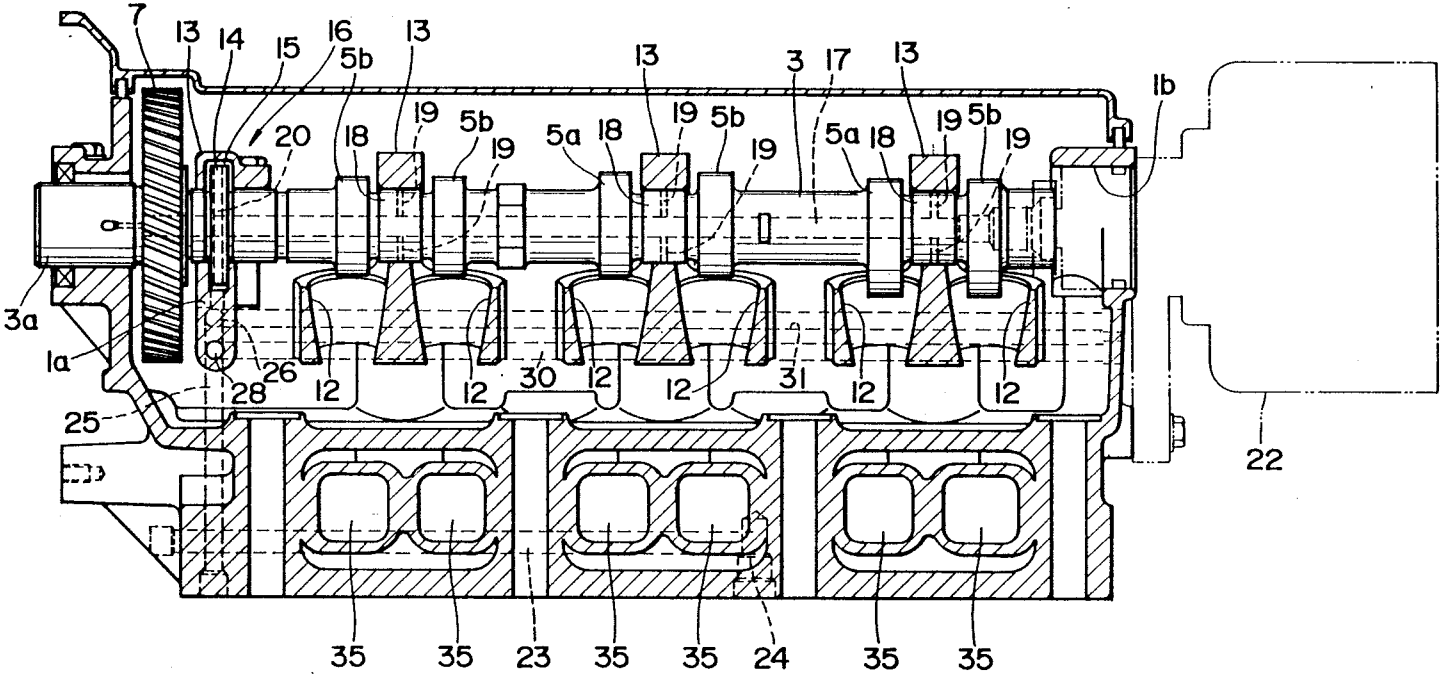
FIG. 3 is a longitudinal sectional view of FIG. 2 taken along line III—III.

As shown in detail in FIG. 3, a thrust restrictive structure 16 is comprised of a thrust collar 14 integrally formed with the exhaust camshaft 3 and a plain split thrust bearing 13 formed with an inner annular groove 15 for receiving the annular thrust collar 14. The thrust bearing 13 consists of an upper half or bearing cap 13*a* formed with an upper half groove 15*a* of the annular groove 15 and a lower half 13*b* forming part of the cylinder head 1 where the bearing cap 13*a* is bolted to and which is formed with a lower half 15*b* of the annular groove 15. The upper half 15*a* of the annular groove 15 is formed wider than the lower half 15*b* of the annular groove 15. Accordingly, the part of the cylinder head 1, as the lower half 13*b* of the thrust bearing 13, formed with the lower half 15*b* of the annular groove 15, supports substantially the whole thrust or axial force loaded on the exhaust overhead camshaft 3, thereby restricting the thrust or axial movement of the exhaust overhead camshaft 3.

Figure 4:
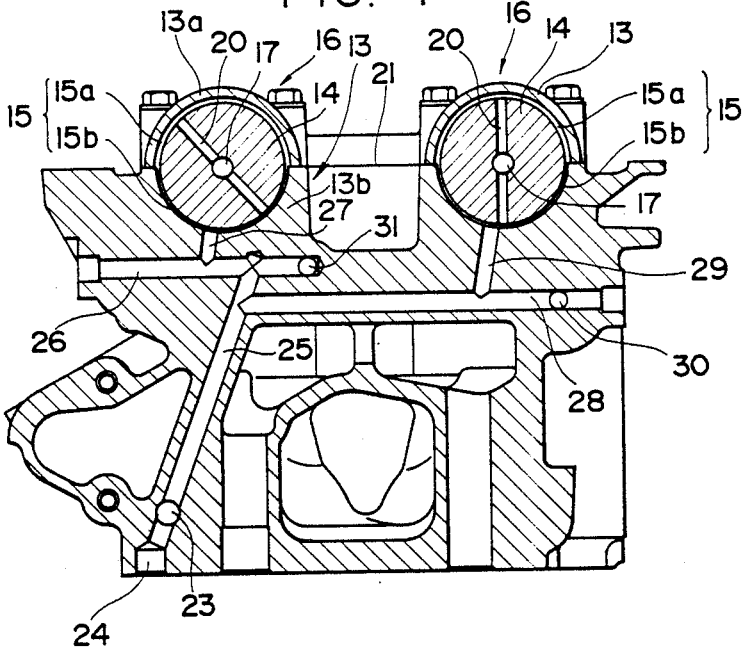
FIG. 4 is a cross-sectional view of FIG. 2 taken along line IV—IV.
Figure 5:
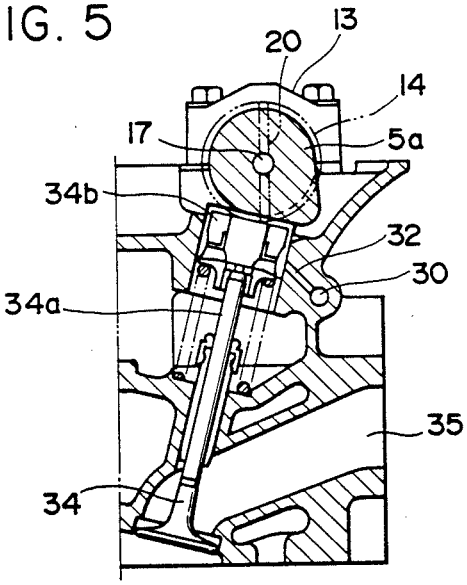
FIG. 5 is a cross-sectional view of FIG. 2 taken along line V—V.

The exhaust overhead camshaft 3 is formed with an axial oil passage 17 along substantially its whole length. The oil passage 17 is communicated with radial oil passages 19 formed in the camshaft bearing journals 18. The thrust collar 14 is formed with radial oil passages 20 which lie on a straight line along a diameter of the thrust collar 14 crossing the axial oil passage 17 and open to the annular groove 15 of the thrust bearing 13. These radial oil passages 20, as shown in detail in FIGS. 4 and 5, are so formed as to be in parallel with a straight line that connects the center of the exhaust cam 5*a* adjacent to the helical gear 7 and a juncture between a base section and a valve opening ramp section of a cam lobe of the exhaust cam 5*a*. The thrust collar 14 orients the oil passage 20 substantially perpendicularly to a plane, which includes therein a fitting surface 21 of the plain split thrust bearing 3, at the beginning of opening the exhaust valves 34 by the exhaust cams 5*a* and 5*b* adjacent to the helical gear 7, thereby minimizing a decrease of rigidity caused in the thrust collar 14 when a maximum thrust is loaded on the exhaust overhead camshaft 3 by the exhaust cams 5*a* and 5*b* adjacent to the helical gear 7. In the positional viewpoint of the exhaust cams 5*a* and 5*b* relative to the helical gear 7, the closer the location of the exhaust cams 5*a* and 5*b* relative to the helical gear 7 is, the harder it is to twist the exhaust overhead camshaft 3. Because of this, decreasing the distance of the cams 5*a* and 5*b* of the exhaust overhead camshaft 3 from helical gear 7 causes a decrease in absorbing torque change, and hence an increase in thrust. Thrust produced by the cams 5*a* and 5*b* adjacent to the helical gear 7 is greater than that produced by any of the other cams of the exhaust overhead camshaft 3. For this reason, the radial oil passage 20 formed in the thrust collar 14 is determined in direction so as to minimize a decrease in rigidity caused in the thrust collar 14 relative to the maximum thrust which depends upon the axial location of the cams 5*a* and 5*b* adjacent to the helical gear 7. The radial oil passage 20 thus directed is prevented from being brought into parallel with the fitting surface 21 of the plain split thrust bearing 16 upon the build-up of a maximum thrust by any of the remaining cams 5*a* and 5*b* other than the cams 5*a* and 5*b* adjacent to the helical gear 7. The other end of the exhaust overhead camshaft 3 opposite to the one end where the sprocket wheel is to be mounted is formed with a mounting bore for mounting a distributor 22 thereon. Denoted by a reference numeral 35 in FIGS. 3 and 5 are exhaust passages extending from the respective cylinders.

Because a thrust restrictive structure with which the intake overhead camshaft 2 is provided is the same in construction and operation as the thrust restrictive structure 16 of the exhaust overhead camshaft 3, no description thereof is needed.

The intake and exhaust overhead camshafts 2 and 3 are lubricated by a pressure engine lubricating system having an oil delivery circuit which is well known to those skilled in the art. The cylinder head 1 is formed in its lower part with an axial oil passage 23 which extends from midway of the cylinder head 1 to a position below the plain split thrust bearing 13 and is substantially parallel to the intake overhead camshaft 2. One end of the oil passage 23, located at the midway of the cylinder head 1 in the axial direction, is communicated, through a connecting oil passage 24, with an oil passage (not shown) of a cylinder block of the double overhead camshaft internal combustion engine to which the cylinder head 1 is assembled. An oil passage 25 extends upward in the cylinder head 1 toward the plain split thrust bearing 13 from the other end of the oil passage 23. The upwardly extending oil passage 25 is communicated at its upper end with a laterally extending oil passage 26 in parallel with the fitting surface 21 of the plain split thrust bearing 13. An oil passage 27 extends upward from midway of the laterally extending oil passage 26 and opens to the annular groove 15 of the plain split thrust bearing 13 for the intake overhead camshaft 2.

Similarly, the vertically extending oil passage 25 is communicated at a position near the upper end with a laterally extending oil passage 28 in juxtaposition with the laterally extending oil passage 26, and hence the fitting surface 21 of the plain split thrust bearing 13. An oil passage 29 extends upward from midway of the laterally extending oil passage 28 and opens to the annular groove 15 of the plain split thrust bearing 13 for the exhaust overhead camshaft 3.

The cylinder head 1 is further formed in the middle part thereof with axial oil passages 30 and 31 extending along substantially the whole length thereof in parallel with the exhaust and intake overhead camshafts 3 and 2, respectively, and is in communication with the laterally extending oil passages 28 and 26, respectively. These axial oil passages 30 and 31 are in communication with the exhaust valve holes 12 and the intake valve holes 11 by way of connecting oil passages 32 and 33, respectively.

As is well known in the art, the pressure engine lubricating system draws lubricating oil from a pun sump by means of an oil pump (not shown). The oil pump then forces the oil, through special oil passages, to crankshaft bearing journals of the crankshaft incorporated in the cylinder block of the V-6 double overhead camshaft internal combustion engine. The lubricating oil partly flows, through the connecting oil passage 24, into the axial oil passage 23 to oil camshaft bearing journals of the intake and exhaust overhead camshafts 2 and 3. The lubricating oil, induced into the oil passage 24 partly flows, through the oil passages 25, 26 and 27, into the annular groove 15 of the plain split thrust bearing 13 for the intake overhead camshaft 2 and partly flows, through the oil passages 25, 28 and 29, into the annular groove 15 of the plain split thrust bearing 13 for the exhaust overhead camshaft 3, so as to oil the thrust collars 14.

The lubricating oil passing up to the thrust collars 14 further flows, through the radial oil passages 20 formed in the thrust collars 14, into the axial oil passages 17 formed in the intake and exhaust overhead camshafts 2 and 3 along their full lengths, respectively. The radial oil passages 19 formed in the respective camshaft bearing journals 18 of the intake and exhaust overhead camshafts 2 and 3 allow the lubricating oil to flow in the axial oil passages 17 to pass up to all bearings 18 for the intake and exhaust overhead camshafts 2 and 3 and thereby oil them.

It should be noted that various changes and modifications are apparent to those skilled in the art which are within the scope of the invention, and such changes and modifications are intended to be covered by the following claims.

What is claimed is:

1. An overhead camshaft structure for a double overhead camshaft internal combustion engine comprising a cylinder block formed with a series of at least three cylinders, a cylinder head and two overhead camshafts formed with a series of cams and a series of camshaft bearing journals for said at least three cylinders, said two overhead camshafts being operatively connected with each other by means of helical gears connected to said two overhead camshafts, respectively, said overhead camshaft structure comprising:

a circular thrust collar formed on each said overhead camshaft;

a thrust bearing comprising upper and lower halves for supporting each said overhead camshaft therebetween, said thrust bearing including a thrust restrictive groove having an upper half formed in said upper half of said thrust bearing and a lower half formed in said lower half of said thrust bearing for receiving therein said circular thrust collar, said upper half of said thrust restrictive groove being wider than said lower half of said thrust restrictive groove; and an oil passage comprising a radial passage portion extending in parallel with a diameter of said circular thrust collar and opening in a periphery of said circular thrust collar and an axial passage portion formed in each said overhead camshaft along its length for allowing lubricating oil to pass up to each said camshaft bearing journal, said radial passage being directed in parallel with a straight line connecting an axial centerline of rotation of each said overhead camshaft and a juncture between a valve opening ramp of a cam lobe and a cam base of said cam.

2. An overhead camshaft structure as defined in claim 1, wherein said lower half of said thrust bearing is formed on said cylinder head and has a width for snugly, rotatably receiving therein said circular thrust collar.

3. An overhead camshaft structure as defined in claim 1, wherein said thrust collar is formed on each said overhead camshaft adjacent to said helical gear.

4. An overhead camshaft structure as defined in claim 3, wherein each said overhead cam shaft has two cams for opening and closing two valves provided for each said cylinder.

5. An overhead camshaft structure as defined in claim 4, wherein each said overhead camshaft is formed with said camshaft bearing journal located between said two cams for each said cylinder.

6. An overhead camshaft structure as defined in claim 5, wherein said double overhead camshaft internal combustion engine has two cylinder banks set at an angle relative to each other including three in-line cylinders in each said cylinder bank and provided with said two overhead camshafts mounted on each said cylinder bank.

7. An overhead camshaft structure as defined in claim 5, wherein said double overhead camshaft internal combustion engine is an in-line three cylinder type engine.

8. An overhead camshaft structure for a double overhead camshaft internal combustion engine having first and second cylinder banks set at an angle to each other, each said cylinder bank including three in-line cylinders and intake and exhaust camshafts mounted overhead a cylinder head for each said cylinder bank, each said camshaft being formed with a series of pairs of cams and a camshaft bearing journal between each said pair of cams, said camshaft structure comprising:

respective helical gears secured to one end of said intake and exhaust camshafts for connecting said intake and exhaust camshafts to each other for timely rotation;

a thrust collar formed between said helical gear and said pair of cams adjacent to said helical gear on each said camshaft;

a thrust bearing comprising upper and lower halves for supporting each said camshaft therebetween, said thrust bearing including a thrust restrictive groove having an upper half formed in said upper half of said thrust bearing and a lower half formed in said lower half of said thrust bearing for receiving therein said thrust collar, said upper half of said thrust restrictive groove being wider than said lower half of said thrust restrictive groove; and an oil passage comprising a radial oil passage portion formed in said thrust collar and an axial oil passage portion formed in each said camshaft along its length for allowing lubrication oil to pass up to each said camshaft bearing journal for lubrication, said radial oil passage being directed in parallel with a straight line connecting an axial centerline of rotation of each said camshaft and a juncture of a valve opening ramp of said cam lobe adjacent to said thrust collar.

* * * * *